United States Patent [19]

Moller et al.

[11] 4,448,108

[45] May 15, 1984

[54] GUIDE SYSTEM FOR A GUN BARREL

[75] Inventors: Rainer Moller, Schweinfurt; Günter Scharting, Gochsheim, both of Fed. Rep. of Germany

[73] Assignee: Fag Kugelfischer Georg Schäfer & Co., Schweinfurt, Fed. Rep. of Germany

[21] Appl. No.: 374,036

[22] Filed: May 3, 1982

[51] Int. Cl.[3] ..... F41F 19/00

[52] U.S. Cl. ..... 89/37 R

[58] Field of Search ..... 42/75 A; 89/37 R, 37 B, 89/37 BA, 37 E, 37 GM, 42 R, 42 B, 162

[56] References Cited

U.S. PATENT DOCUMENTS 615,959 12/1898 Dawson et al. ..... 89/37 R 2,719,460 10/1955 Leek ..... 89/37 BA 2,729,975 1/1956 Hawthorne et al. ..... 89/42 R 2,752,714 7/1956 Landwehr ..... 42/75 A

*Primary Examiner*—Stephen C. Bentley

*Attorney, Agent, or Firm*—Karl F. Ross; Herbert Dubno

[57] ABSTRACT

A guide system for the longitudinal recoil movement of a cannon has a pair of guide units spaced apart along the cannon barrel and each having a plurality of rollers angularly spaced about the barrel. At least one roller is elastically biased against the barrel while other rollers of the units are radially fixed to provide firm guidance of the barrel without play under all conditions and enabling the yieldable roller to adjust to the increase in barrel size with increasing temperature resulting from firing of the weapon.

5 Claims, 4 Drawing Figures

GUIDE SYSTEM FOR A GUN BARREL

FIELD OF THE INVENTION

Our present invention relates to a longitudinal guide arrangement for a cannon and, more particularly, to a guide for a large-caliber or large-bore weapon which permits recoil unaffected by thermal factors.

BACKGROUND OF THE INVENTION

In large-caliber weapons, especially cannons, a guide arrangement is customarily provided to permit longitudinal movement of the barrel of the cannon for the recoil thereof.

It is important for a high firing rate that this movement should be as free as possible. For high firing accuracies, moreover, the movement should be free from play to the greatest possible extent.

In the past the guide arrangements which were used provided slideways in which the barrel was shifted and which received the barrel with a certain amount of play since, with rapid firing, the barrel became heated and this play was necessary to prevent binding of the barrel in the guide. As a result, the play introduced inexactitudes in the positioning of the weapon and decreased the firing precision.

OBJECTS OF THE INVENTION

It is the principal object of the present invention to provide an improved guide system for the linear displacement of the barrel of a weapon, i.e. a cannon whereby the aforementioned disadvantages are obviated.

Another object of the invention is to provide a guide system for a cannon barrel which minimizes the play between the guide system and the barrel and hence increases the firing precision of the weapon even as the latter undergoes expansion due to increasing temperatures.

Still another object of this invention is to provide an improved guide arrangement for the longitudinal movement of a cannon barrel which precludes binding with thermal expansion but yet does not introduce play into this system.

SUMMARY OF THE INVENTION

These objects and other which will become apparent hereinafter are attained, in accordance with the invention, in a guide system for a cannon barrel which comprises at least two guide units spaced apart along the barrel of the gun and in which the barrel is supported for longitudinal movement, each of these guide units being formed with a plurality of roller guide elements spaced apart around the periphery of the barrel and rollingly engaging same. According to an important feature of the invention, at least one of these elements of each unit is yieldably biased against the barrel and is movable against the biasing force, e.g. upon thermal expansion of the barrel to automatically compensate for this expansion while continuing to provide rolling engagement of the barrel.

Advantageously, the yieldable element bears upon half of the barrel while the opposite half of the barrel is supported by at least one and preferably two elements of the respective unit. The rolling elements which are not yieldable, i.e. the other rolling elements of each unit, can be fixedly positioned with respect to the housing or support relative to which the barrel is displaced.

According to a feature of the invention, three support rollers constitute each unit and are angularly equispaced from one another about the axis of the barrel, these rollers having axes which lie in a plane perpendicular to the axis of the barrel and extending tangentially to a circle centered on this axis in this plane. One of these rollers is elastically biased while the other have fixed axes and, according to a feature of the invention, the two rollers which bear the weight of the barrel can have fixed axes while the downwardly directed roller is the elastically biased element.

According to another feature of the invention, each roller is outwardly concave and shaped approximately to be complementary to the convex shape of the barrel which it engages, the rollers having axially extending axial stubs which preferably are journaled in ball or roller bearings so that rotation of the rollers relative to the stubs is possible with a minimum of friction.

The stub of the elastically biased roller can be received in a block which is radially shiftable in the housing with respect to the axis of the gun barrel. Against this block, a comparison spring can bear and we have found it to be advantageous to provide means for adjusting the compression load of this spring.

The concave profile of the roller can have a greater radius of curvature than the periphery of the barrel so that the surface forces transmitted between the rollers and the barrel can be minimized.

It will be apparent that the radial yieldability of the biased roller can accommodate the expansion of the barrel due to heating with a minimum of increased force between the two. The heating of the barrel thus does not result in detrimental binding and a predetermined prestress is provided between the guide way and the barrel so that play does not develop.

When the elastic elements are dished-disk springs or Belleville washers, the system can be very compact and the yielding of the roller can be permitted without significant increase in the force applied by the roller to the barrel.

The use of roller bearings or ball bearings between the roller body and the housing, i.e. between the roller body and the axial stub or between the axial stubs and the housing, further reduces stress and friction.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
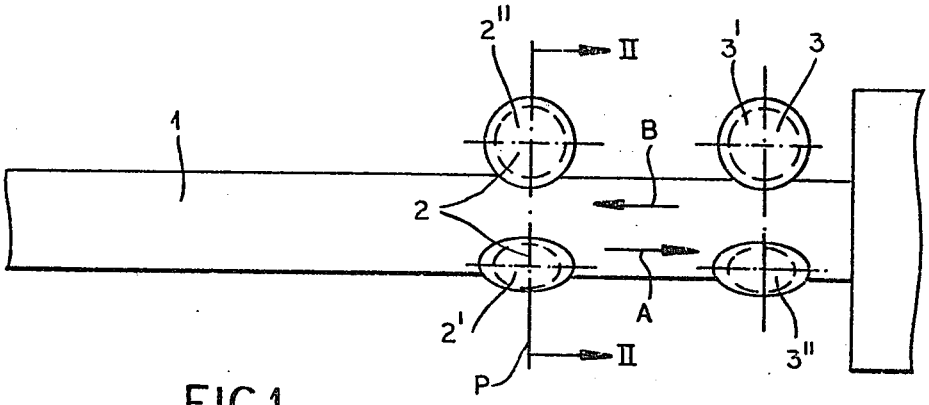
FIG. 1 is a diagrammatic side elevational view showing the positions of two guide arrangements according to the invention.

FIG. 1 shows diagrammatically a cannon barrel 1 with two guide arrangements 2, 3, axially spaced apart along the barrel and permitting the recoil movement (arrow A) and return movement (B), the latter being controlled by springs or other means conventional in the art.

Each guide unit 2 or 3 comprises a plurality of guide rollers 2', 2'' or 3', 3'' . . . spaced around the barrel and lying in a plane of the unit perpendicular to the axis of the barrel, e.g. as represented by the pulley P in FIG. 1.

Figure 2:
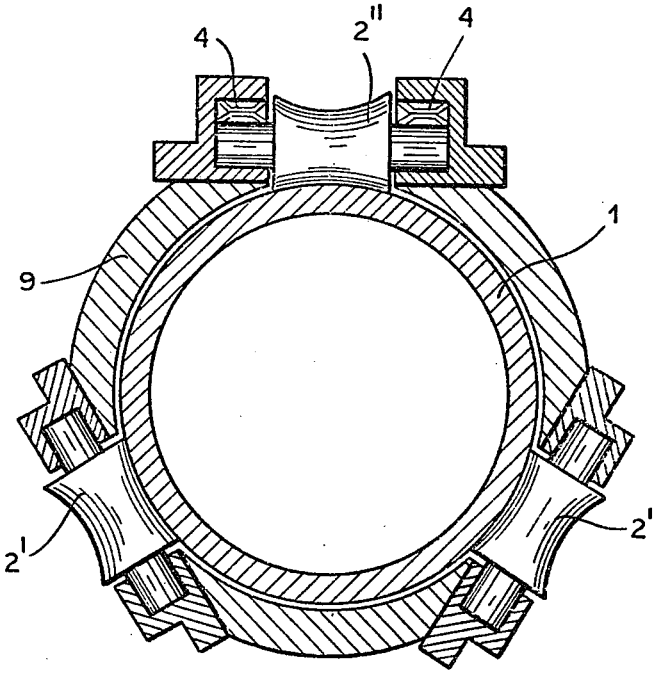
FIG. 2 is a cross sectional view taken along the line II—II of FIG. 1 but showing one of the guide arrangements or units in greater detail.

In a preferred embodiment of the invention and as shown in FIG. 2, each unit or group comprises three angularly equispaced rollers including two radially fixed rollers 2' supporting the weight of the barrel, and one radially shiftable roller 2'' which bears upon the barrel from above.

The downward bias of the roller 2'' is provided by a pair of diagrammatically shown compression springs (FIG. 2) represented at 4.

In practice, the roller 2'', which is concave so as to be complementary to the convex surface of the barrel 1, can have a pair of pressure springs 4 bearing downwardly on the opposite ends of the roller 2''.

More specifically, while all of the rollers 2' and 2'' lie in a common plane and have axes which are tangential to an imaginary circle centered on the axis of the cannon barrel, two of the rollers 2'' are so mounted in the housing surrounding the barrel that they are not free to move radially.

Since the same applies to the support rollers 3' of the second group or unit 3, a highly precise guiding of the barrel is ensured.

Figure 3:
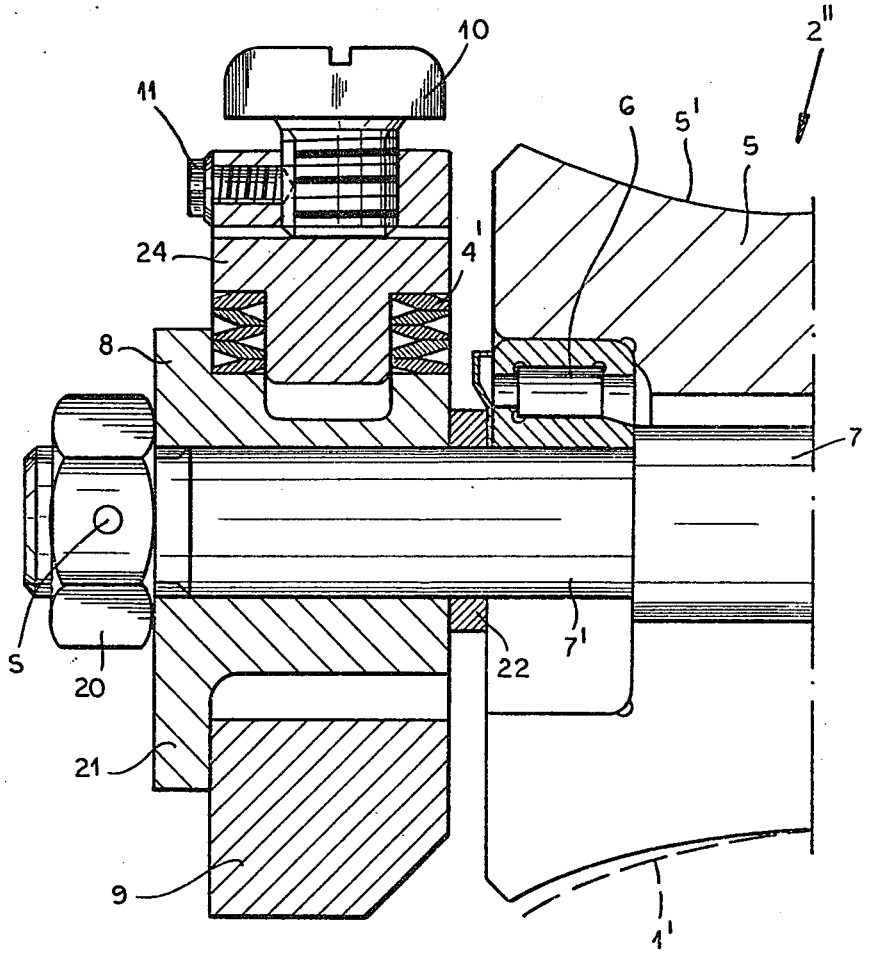
FIG. 3 is a detail view of the bias-adjusting means of a yieldable roller assembly according to the invention, partly broken away.
Figure 4:
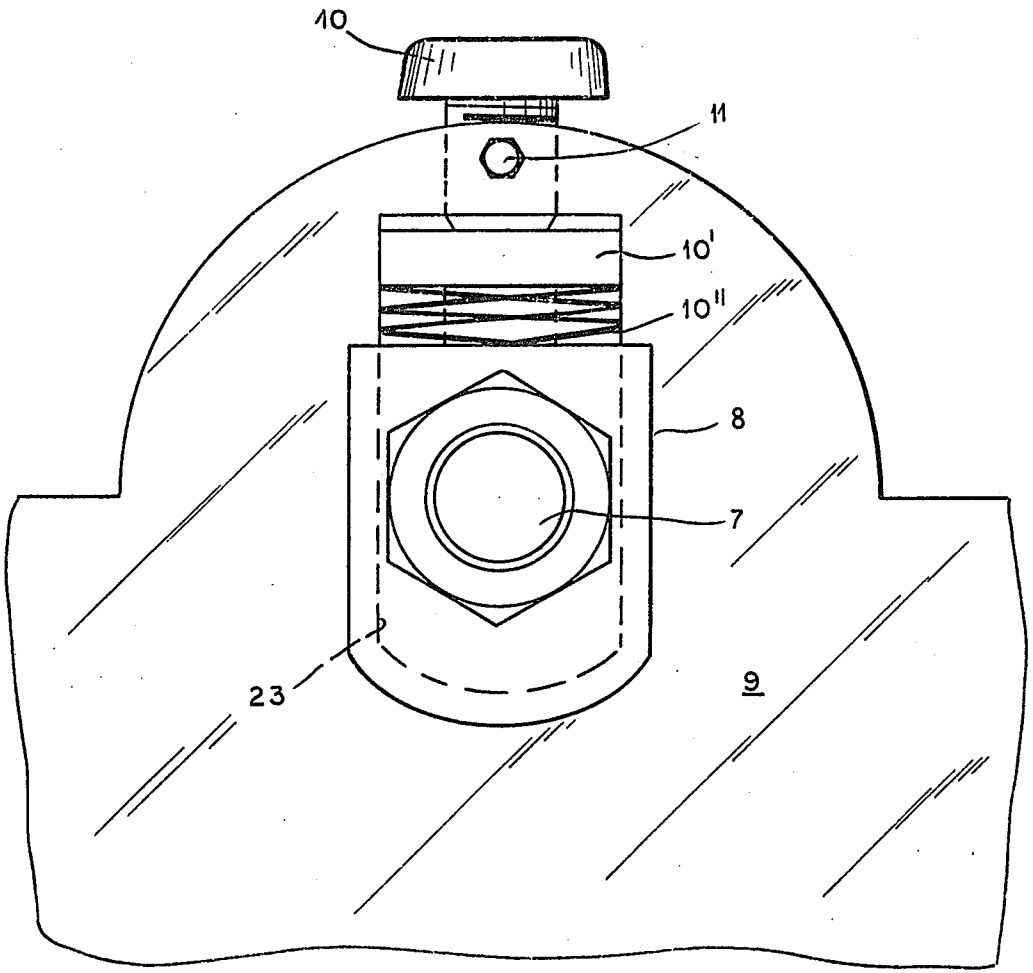
FIG. 4 is a side elevational view of this portion of the assembly.

As can be seen from FIGS. 3 and 4, the support roller 2'' comprises a roller body 5 whose profile 51 is substantially complementary to that of the barrel except that, as can be ascertained from the dot-dash line 1', it has a greater radius of curvature than that of the barrel. The roller body 5 is journaled by a pair of cylindrical rollers or pin bearings 6 upon the axle 7 which extends completely through the sleeve-shaped roller body and only one end of which has been shown.

At each end, however, the axle 7 has stubs 7' which are engaged by nuts 20 to clamp a sleeve 21 against a washer 22 and the inner base of the bearing 6.

The sleeve 21 forms a body which is guided in a radial slot 23 of the housing 9. A packet of dished-disk springs or Belleville washers 4' bears upon the sleeve 21 and is comprised by a spring seat 24 which is urged by a screw 10, threaded into the housing 9, downwardly. The adjusting screw 10, which regulates the elastic bias of the yieldable roller, can be locked in place by a set-screw 11.

Naturally, the prestress can also be provided by other means, e.g. by hydraulic pressure applied to a spring or directly to member 8, by pneumatic pressure or the like. Furthermore, the shaft 7 can be connected to the roller 5 and a roller bearing provided between the shaft stub and the member 8.

We claim:

1. A guide arrangement for a cannon barrel comprising a pair of guide units spaced apart along said barrel and enabling longitudinal displacement thereof, each of said units comprising a plurality of guide rollers spaced around said barrel and engaging same, the rollers of each unit being mutually coplanar and including at least one yieldably biased roller bearing upon said barrel, comprising an axle, and yieldable upon thermal expansion thereof so as to prevent development of play between said units and said barrel, and means comprising elastic elements bearing against said axle for biasing said yieldable rollers against said barrel.

2. The guide arrangement defined in claim 1, further comprising screw adjusting means for varying the pressure of said elastic element upon said yieldable rollers.

3. The guide arrangement defined in claim 2 further comprising antifriction bearings rotatably journaling said rollers.

4. The guide arrangement defined in claim 3 wherein at least one of the antifriction bearings is disposed between said axle and said yieldable roller.

5. The guide arrangement defined in claim 1 wherein said rollers have concave profiles substantially complementary to the profile of said barrel but of a radius of curvature greater than the radius of curvature of said barrel.

* * * * *